US009284024B2

(12) United States Patent
Kuenzel

(10) Patent No.: US 9,284,024 B2
(45) Date of Patent: Mar. 15, 2016

(54) SHALLOW WATER ANCHOR FOR A FISHING BOAT

(71) Applicant: Rainer Kuenzel, Hunt, TX (US)

(72) Inventor: Rainer Kuenzel, Hunt, TX (US)

( * ) Notice: Subject to any disclaimer, the term of this patent is extended or adjusted under 35 U.S.C. 154(b) by 0 days.

(21) Appl. No.: 14/682,153

(22) Filed: Apr. 9, 2015

(65) Prior Publication Data

US 2015/0298771 A1 Oct. 22, 2015

Related U.S. Application Data

(60) Provisional application No. 61/995,642, filed on Apr. 17, 2014.

(51) Int. Cl.
*B63B 21/26* (2006.01)

(52) U.S. Cl.
CPC ..... *B63B 21/26* (2013.01)

(58) Field of Classification Search
CPC ..... B63B 21/26
See application file for complete search history.

(56) References Cited

U.S. PATENT DOCUMENTS 6,041,730 A * 3/2000 Oliverio ..... B63B 21/26 114/230.13
7,971,548 B2 * 7/2011 Kuenzel ..... B63B 21/00 114/294

* cited by examiner

*Primary Examiner* — Edwin Swinehart

(57) ABSTRACT

A shallow-water anchor comprises a parallelogram design which is relatively low cost to manufacture. It is electrically powered, eliminating cumbersome hydraulic components. The anchor moves down and out of the way when in operation. Two such anchors can be installed at an angle such that their outer ends and vertical rods are far apart to provide maximal holding power to prevent the boat from weather-vaning. Its electrical power source is located on top of the boat and is never under water, making the installation of the anchor very easy.

7 Claims, 7 Drawing Sheets

5
5
"D"
20
31
23
21
25
16
3
31
"C"
46
24
"B"
18
14
30
26
60
50
22
28
42
"A"
32
3

SHALLOW WATER ANCHOR FOR A FISHING BOAT

This application claims the benefit of U.S. Provisional Patent Application No. 61/995,642, filed Apr. 17, 2014.

FIELD OF THE INVENTION

This invention relates generally to the field of boat anchors and, more particularly, to a boat anchor adapted for use in shallow waters.

BACKGROUND OF THE INVENTION

Shallow water anchors presently available on the market typically include an objective to lower a rod, usually made from fiber glass, vertically from the stern of the fishing boat into the water, until it reaches the bottom of a body of water, such as a pond, lake, or slow moving river, to hold the boat in position and keep it from drifting away because of pressure from wind, current, or wave action.

One available shallow water anchor comprises a parallelogram design and is powered by a hydraulic cylinder, requiring a hydraulic pressure system, hydraulic fluid, hoses, valves, and other auxiliary equipment.

Another known anchor comprises a permanently upright main structure with an electric power system at its top end, to drive a fiber glass rod vertically out from its bottom to engage to lake bottom. This, while being powered by an electric motor, has the disadvantage of always being at an upright position and eventually getting in the way of the anglers' activity. It is also a disadvantage to have the rod engaging the bottom so very close to the edge of the boat, compared with the above mentioned parallelogram design, which can put bottom engagement points of two rods (when two anchors are used to keep the boat from weather-vaning) at a larger distance from each other, when the two anchors are attached to the transom wall at outward pointing angles.

A third available option is an anchor with a parallelogram beam design like the first described design, but instead a hydraulic cylinder, it uses a linear electric motor between the parallel beams to lower the anchor. This puts the electric linear motor under water when in use, which in itself is not a good idea. Even if an effort is made to seal the water out of any electrical components, it is at least questionable if this will hold up in the long run, especially in saltwater; besides, it represents a scary proposition, when it comes to convincing a potential customer, that no water will ever manage to reach any electrical parts during the lifetime of the anchor.

SUMMARY OF THE INVENTION

It is therefore desirable to provide an anchor design that combines the advantages of the above mentioned options and avoids their disadvantages. The present invention therefore is of a parallelogram design, which is relatively low cost to manufacture, its function and reliability are easily visible to a potential buyer. It is electrically powered, avoiding cumbersome hydraulic components. The anchor disclosed here moves down and out of the way when in operation; two of these anchors can be installed at an angle such that their outer ends and vertical rods are far apart to provide maximal holding power to prevent the boat from weather-vaning; its electrical power source is located on top of the boat and is never under water (splash proofing and weather proofing will suffice), making the installation of the anchor very easy, even for a layman.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DESCRIPTION OF PREFERRED EMBODIMENTS

Figure 1:
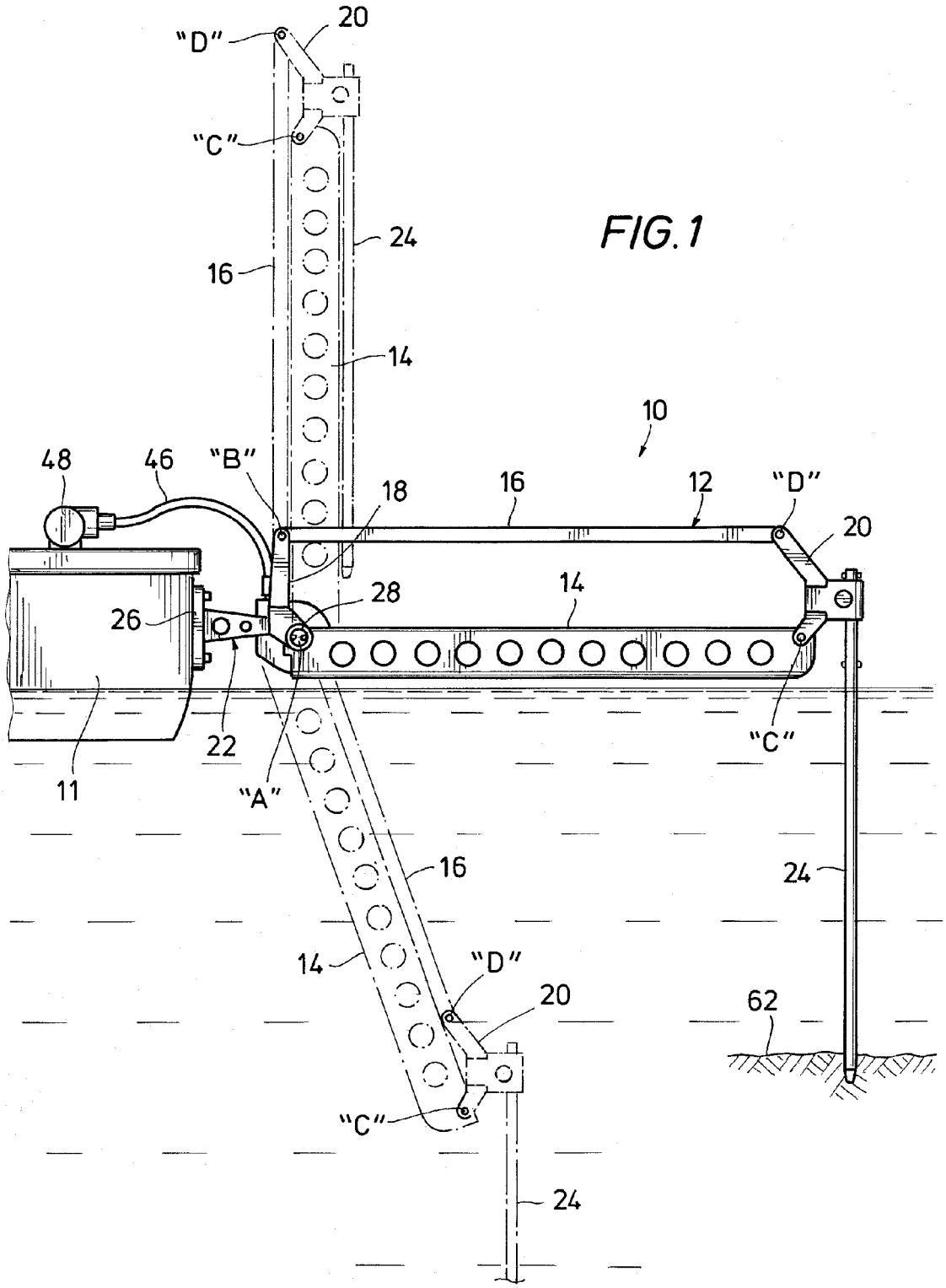
FIG. 1 is side elevation view of presently preferred embodiment of a shallow water anchor in three positions.

Referring to FIG. 1, an anchor 10, preferably mountable to the stem of a shallow-water fishing boat 11, comprises a parallelogram beam 12, formed of a primary load-bearing beam 14, a secondary beam 16, and connecting arms 18 and 20. These four arms form a parallelogram with the corner points A, B, C and D. The connecting arm 18 is an integral part of a mounting base 22. Therefore, points A and B are in a fixed position. The lengths of the arms 18 and 20 are equal, and so are the lengths of the beams 14 and 16. This means that a rod 24 will always be vertical, or parallel to a base plate 26 affixed to the stern of the boat 11, no matter in which direction the parallelogram is rotated. The base plate 26 is an integral part of mounting base 22. The rod 24 is arranged to be stuck into a lake bottom, provided the water is shallow enough.

Figure 2:
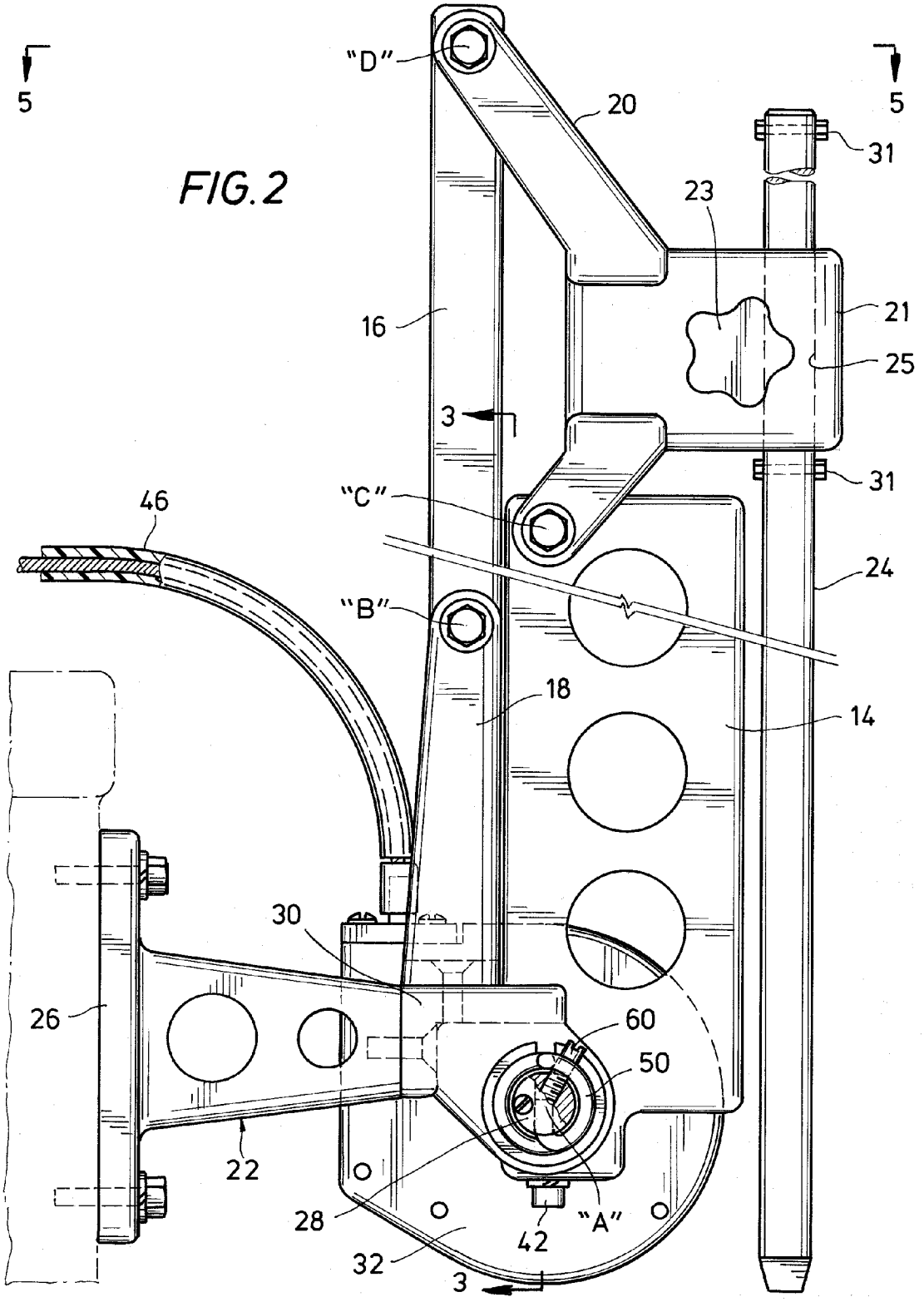
FIG. 2 is an enlarged side view of the anchor in storage position.
Figure 5:
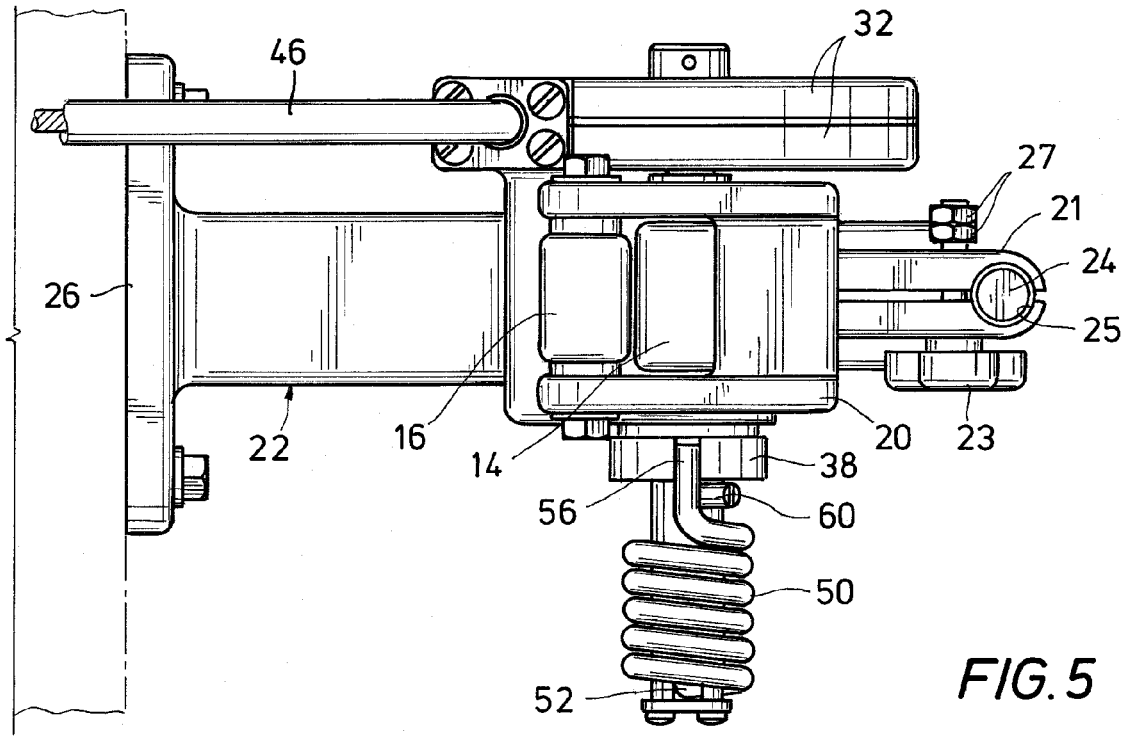
FIG. 5 is a top view as indicated in FIG. 2.

Referring to FIG. 2, primary beam 14 is rotatably mounted to the mounting base 22 at point A by a shaft 28. The arm 20 includes a plate 21, which is slotted, as shown in FIG. 5, and is provided with a passage 25 to hold the rod 24, preferably made of fiberglass. A hand-operated knurled knob 23 serves to tighten the passage 25 around rod 24 to hold it firmly in place. Jam nuts 27 (See FIGS. 5 and 6) prevent screw 23 from getting accidentally unscrewed too far. To prevent the rod 24 from sliding all the way out of the plate 21, a pair of pins 31 are positioned above and below the plate 21. Note also that the rod 24 may extend well above the plate 21 so that the length of the rod extending below the plate (and thus into the lake bottom) may be adjusted as desired by the user.

Figure 3:
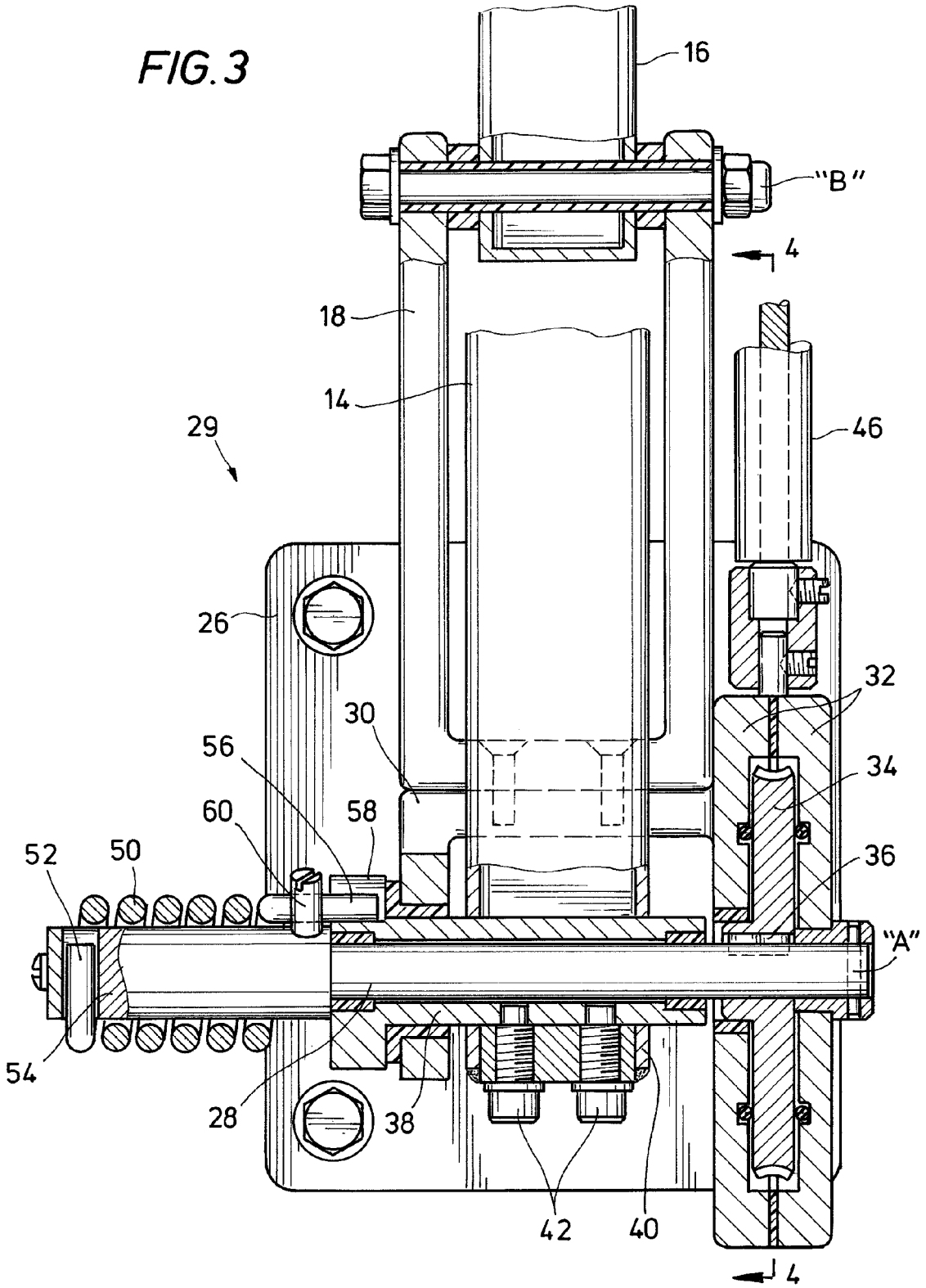
FIG. 3 is a rear view cross-section as indicated in FIG. 2.

FIG. 3 illustrates a presently preferred electrical driving mechanism 29. The shaft 28 extends through a yoke 30, which contains a worm gear 34, and to which the shaft 28 is connected via a key 36. A hollow shaft 38 surrounds the shaft 28 and is connected to a lower end 40 of the primary beam 14 via a pair of bolts 42.

Figure 4:
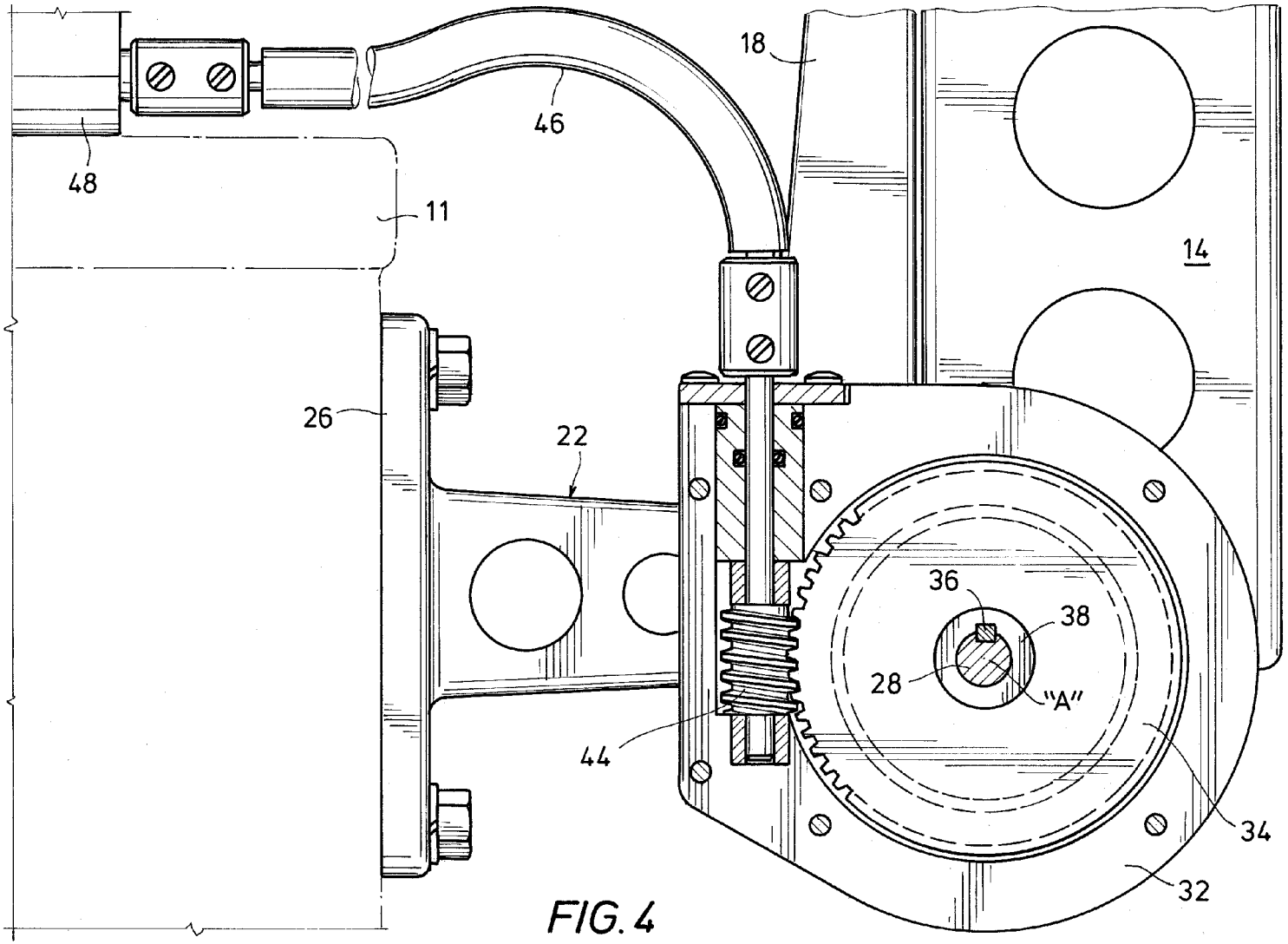
FIG. 4 is a partial cross-section as indicated in FIG. 3.

The worm gear 34 is engaged to a worm 44 as shown in FIG. 4, which in turn is rotated via a flexible shaft 46 and an electrical geared motor 48, shown also in FIG. 1. The rotation of the worm gear 34 and the shaft 28 is transmitted into the hollow shaft 38 and therefore the primary beam 14 by a torsion spring 50, thus representing a flexible connection between the electrical drive motor 48 and the anchor arms. This flexible connection accounts for wave action acting on the boat while the rod is embedded in the lake bottom. One end 52 of the torsion spring 50 is connected to an end 54 of the shaft 28, and the other end 56 of the torsion spring 50 engages a slot 58 of the shaft 38.

Figure 6:
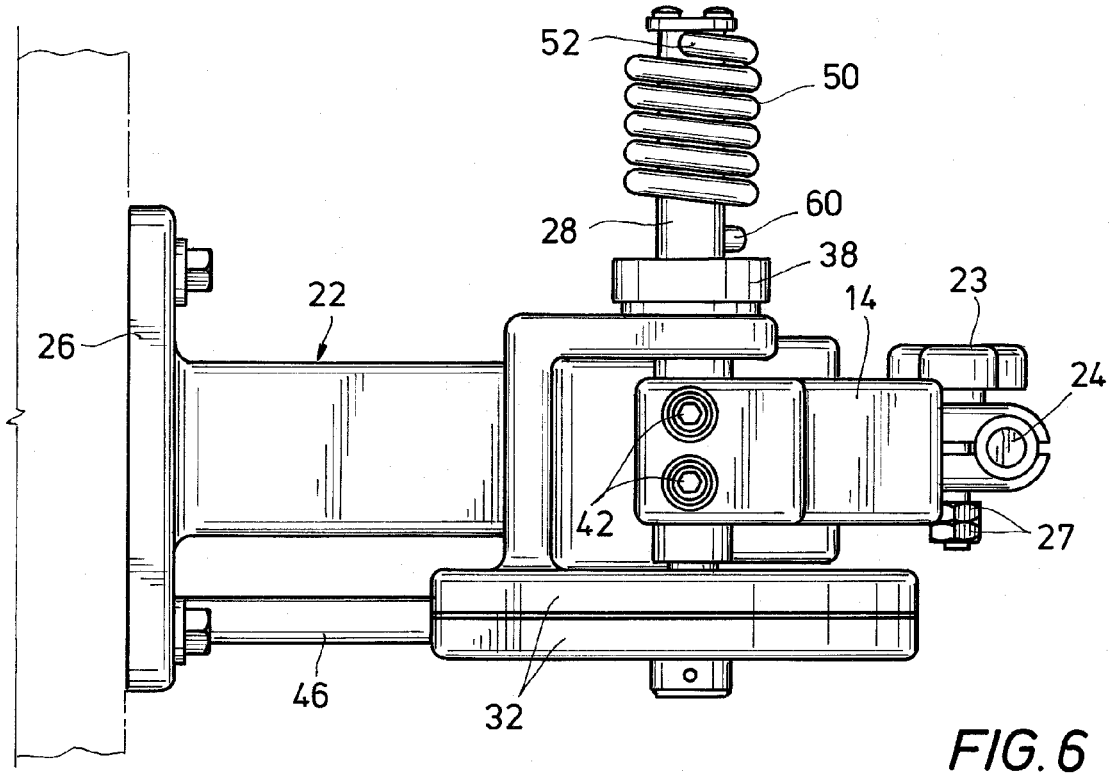
FIG. 6 is a bottom view of the structure of FIG. 5.

A top view of this structure is shown in FIG. 5 and a bottom view is shown in FIG. 6.

Figure 7:
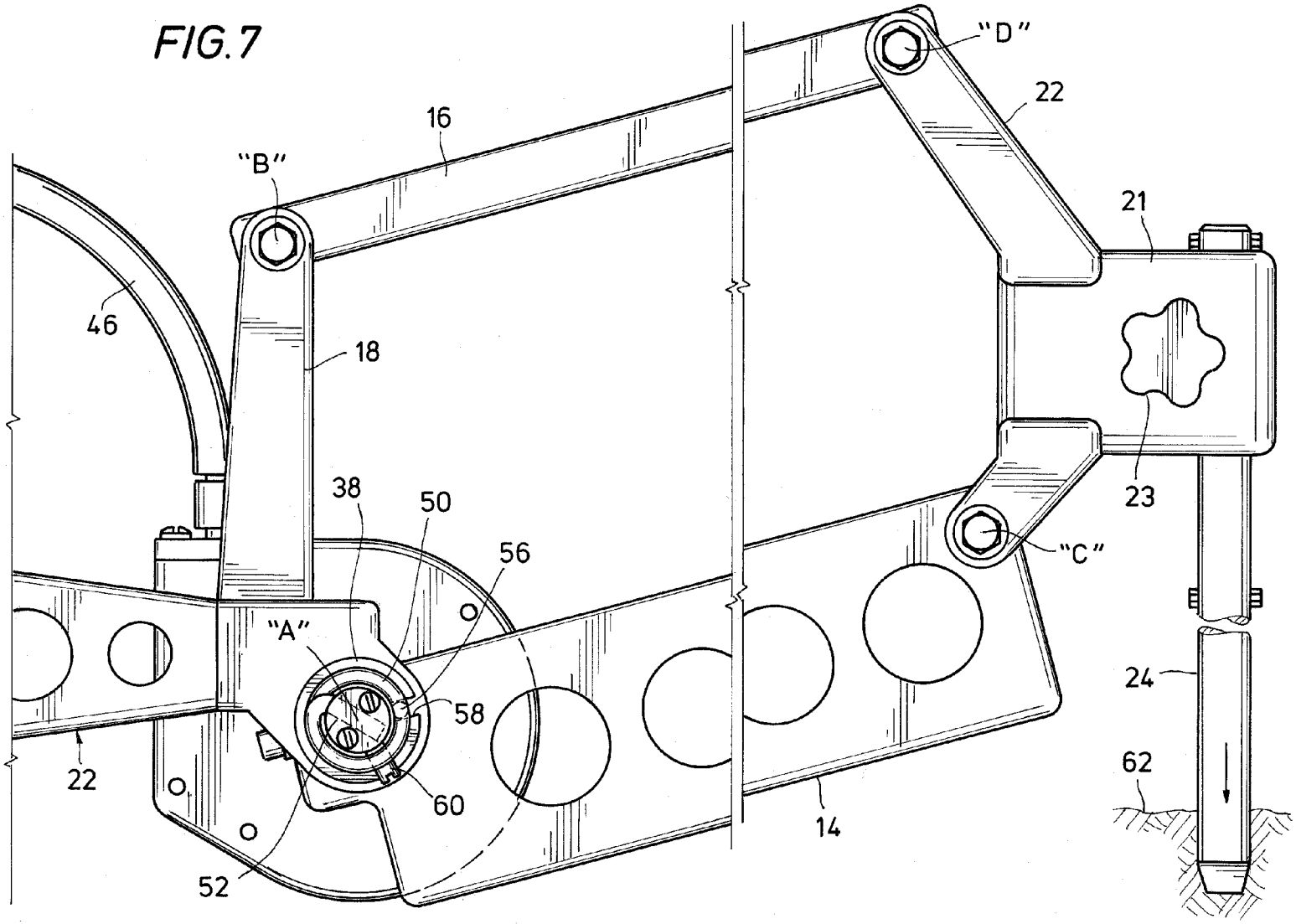
FIG. 7 is a side elevation view, of FIG. 2, the anchor in partially deployed position.

Referring to FIG. 7, the anchor is shown partially lowered to a position where the rod 24 is touching the lake bottom 62 and has come to a stop, while the electrical motor 48 has been kept running a little longer to put extra torque into the torsion spring 50, by rotating shaft 28 beyond the stopping point of rod 24. A pin 60, which is part of the shaft 28, has moved clockwise, as shown in FIG. 7, indicating the extra rotation at spring end 56 of spring 50.

When the boat now heaves up and down in wavy water conditions, rod 24 maintains contact with ground 62 because beam parallelogram 12 can rotate around the point A, using up or replenishing the stored torque of spring 50, providing wave compensation.

Figure 8:
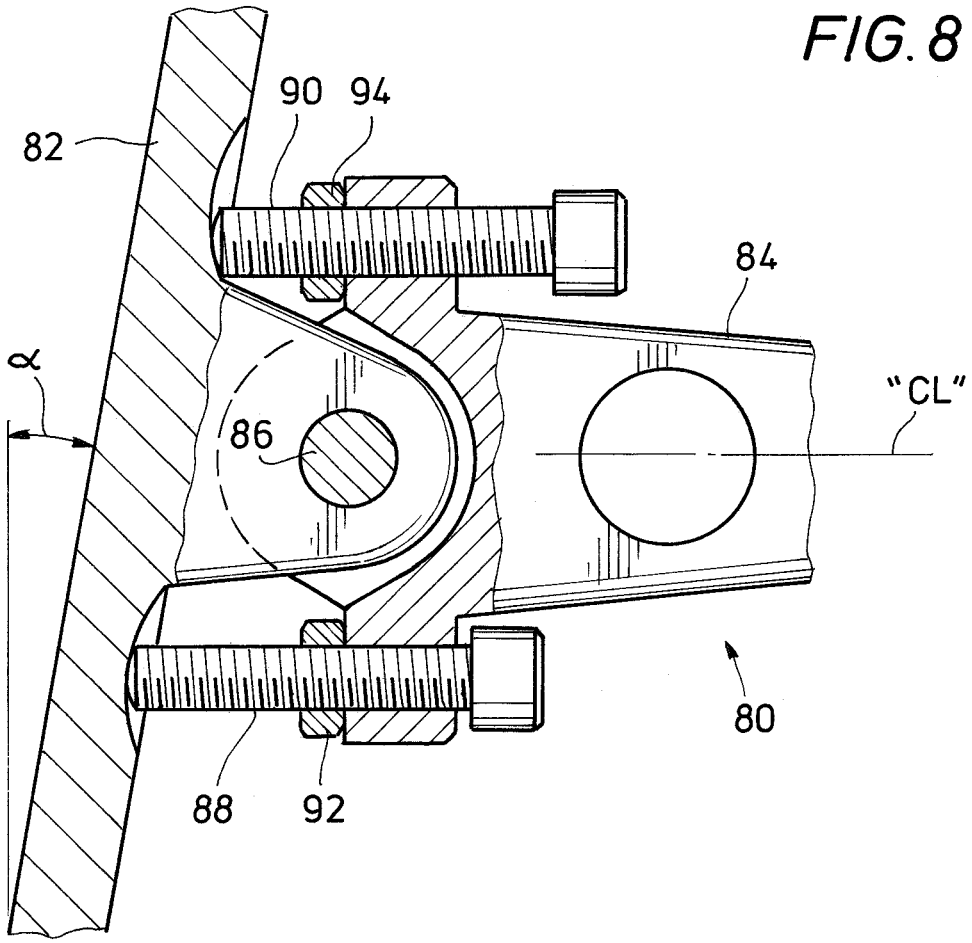
FIG. 8 is a presently preferred embodiment of a shallow water anchor.
Figure 9:
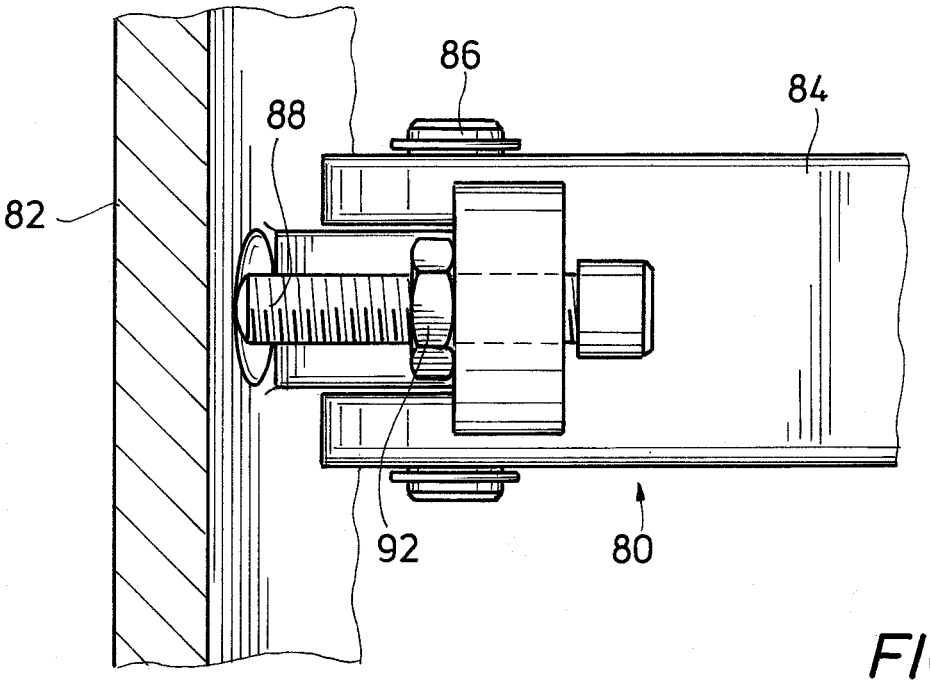
FIG. 9 is a bottom view of FIG. 8.

FIGS. 8 and 9 illustrate an alternative design for mounting the mounting base 22. Here, a mounting base 80 is equipped with a hinge in two parts, a base plate 82 and a stem 84, connected by a hinge pin 86. Angle alpha represents the angle of the transom wall of the boat, to which the base plate 82 can be adjusted by manipulating the position of a bottom adjustment bolt 88 and a top adjustment bolt 90, while the center line CL of a stem 84 remains parallel to the waterline, and therefore the position of the retracted anchor remains vertical, meaning that the rod 24 also remains vertical. Jam nuts 92 and 94 prevent the adjustment bolts 88 and 90 from unintentional loosening.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A shallow-water anchor configured to be mounted to a substantially vertical exterior surface of a boat, the anchor comprising:

parallelogram beam comprising:

a primary beam;

a secondary beam parallel to the primary beam;

a first connecting arm; and a second connecting arm parallel to the first connecting arm, the primary beam, the secondary beam, the first connecting arm, and the second connecting arm coupled together to form a parallelogram;

a mounting base rigidly affixed to the first connecting arm so that the first connecting arm remains in a vertical position, the mounting base configured to be mounted to a substantially vertical exterior surface of a boat;

a vertical rod joined to the primary beam and the second connecting arm, so that the rod remains in a vertical position;

an electrical geared motor configured to be mounted on top of the boat;

a gear affixed to the main beam; and a flexible shaft operatively coupling the motor to the gear.

2. The anchor of claim 1, further comprising a flexible connection between the gear and the primary beam.

3. The anchor of claim 2, wherein the flexible connection comprises:

a first shaft affixed to the gear;

a second, hollow shaft around the first shaft;

a torsion spring joined to the first and second shafts for flexible movement between the first and second shafts.

4. The anchor of claim 1, further comprising a plate integral to the second arm, the plate defining a channel therethrough to receive the rod.

5. The anchor of claim 4, further comprising a first pin through the rod and positioned above the plate and a second pin through the rod and positioned below the plate to prevent the rod from slipping out of the plate.

6. The anchor of claim 1, wherein the mounting base comprises:

a base plate;

a stem; and a hinge pin holding the stem to the base plate, wherein the stem is free to rotate about the hinge pin.

7. The anchor of claim 6, further comprising:

a top adjustment bolt through the stem; and a bottom adjustment bolt through the stem, the top and bottom adjustment bolts adapted to selectively position the stem in a fixed relation to the base plate, by rotation about the hinge pin.

* * * * *